US005759123A

United States Patent [19]

Ou

[11] Patent Number: 5,759,123

[45] Date of Patent: Jun. 2, 1998

[54] SEWING RUBBER AMERICAN FOOTBALL AND MANUFACTURING METHOD THEROF

[76] Inventor: Tsung Ming Ou, No. 32, Lane 56, Chung Cheng 2nd Road, Kaohsiung, Taiwan

[21] Appl. No.: 772,943

[22] Filed: Dec. 24, 1996

[51] Int. Cl.[6] ..... A63B 41/10

[52] U.S. Cl. ..... 473/599

[58] Field of Search ..... 473/601, 605, 473/614, 615, 1, 596, 597, 598, 599, 148, 155, 159, 167

[56] References Cited

U.S. PATENT DOCUMENTS

| | | | |
|---|---|---|---|
| 601,520 | 3/1898 | Longden | 473/603 |
| 2,653,818 | 9/1953 | Tebbetts | 473/604 |
| 2,665,132 | 1/1954 | Robinson | 473/599 |
| 2,700,545 | 1/1955 | Axton | 473/599 |
| 3,256,019 | 6/1966 | Barton | 473/597 |
| 3,512,777 | 5/1970 | Henderson | 473/597 |
| 4,169,594 | 10/1979 | Crane | 473/604 |
| 4,305,583 | 12/1981 | Tandon | 473/609 |
| 4,660,831 | 4/1987 | Kralik | 473/603 |
| 4,998,728 | 3/1991 | Traub | 473/605 |

*Primary Examiner*—Theatrice Brown

*Attorney, Agent, or Firm*—David & Raymond; Raymond Y. Chan

[57] ABSTRACT

A sewing rubber American football includes a rubber made ball cover having a valve hole thereon and a rubber bladder, which is disposed within the ball cover, having a predetermined shape and a valve stem mounted thereon and extended through the valve hole of the ball cover. The ball cover includes four elliptical cover pieces sewn edge to edge together. Each cover piece includes an outer elliptical rubber skin and an inner elliptical fabric pad integrally attached underneath the rubber skin. A top surface of the rubber skin provides a plurality of protruding pebbles evenly distributed all over the top surface. The rubber skin has a coarse bottom surface full of bumps and dents for gripping with the fiber of the fabric pad so as to firmly united with the fabric pad. Thereby, the rubber skin is reinforced by the fabric pad to form the tough and rigid cover piece which is able to be sewn easily. A ball cover made of such cover pieces is easily be grasped and thus has good slippery resistibility.

2 Claims, 3 Drawing Sheets

SEWING RUBBER AMERICAN FOOTBALL AND MANUFACTURING METHOD THEROF

BACKGROUND OF THE INVENTION

The present invention relates to American football, and more particularly to a sewing rubber American football, having a rubber made ball cover which comprises four reinforced rubber made cover pieces sewn edge to edge together.

American football is one of the most popular sporting in United States. The conventional American football, as shown in FIG. 1, generally comprises a ball cover 11 and an inflatable rubber bladder 12 disposed within the ball cover 11 for propping up the ball cover 12 after inflation. The ball cover 11 of the made American football comprises a plurality of cover pieces 111 sewn edge to edge together to form an ellipsoidal shape. One of the most common material of the ball cover 11 is leather. Synthetic leather, such as polyvinyl chloride (PVC) or polyurethane (PU), is another common material for the ball cover 11 because of its toughness nature which is more suitable for sewing. The American football players use their hands to grip, catch, transfer, flow, and hold the football. Therefore, the football provides a plurality of small circular protruding pebbles 112 distributing all over the outer surface of the synthetic leather ball cover 11, so as to facilitate the players to grip or hold the American football.

Although the PVC or PU material enables the ball cover 11 to be sewn, however the rigid nature of the PVC or PU ball cover is slippery. Even though the outer surface of the PVC or PU ball cover 11 provides the plurality of circular protruding pebbles 1111 thereon, the slipping resistibility of the PVC or PU ball cover is still beyond standard. Especially, when the player is sweating, the wet surface of the ball cover 11 is still very slippery to hold or grip. It is well know that rubber has very excellent slipping resistibility. Even the wet rubber surface has a better slipping resistibility, therefore all the auto tires are made of rubber. However, the soft and flexible nature of rubber makes it impossible to be sewn.

SUMMARY OF THE PRESENT INVENTION

It is an object of the present invention to provide a sewing rubber American football, in which the ball cover is made of four rubber made cover pieces sewing edge to edge together, wherein the basic nature of the rubber made cover pieces are improved to achieve the tough, rigid and easy to sew features.

Accordingly, a sewing rubber American football of the present invention comprises a rubber made ball cover having a valve hole thereon and a rubber bladder, which is disposed within the ball cover, having a predetermined shape and a valve stem mounted thereon and extended through the valve hole of the ball cover. The ball cover comprises four elliptical cover pieces sewn edge to edge together. Each cover piece comprises an outer elliptical rubber skin and an inner elliptical fabric pad integrally attached underneath the rubber skin. A top surface of the rubber skin provides a plurality of protruding pebbles evenly and uniformly distributed all over the top surface. The rubber skin has a coarse bottom surface full of bumps and dents for gripping with the fiber of the fabric pad so as to firmly united with the fabric pad. Thereby, the rubber skin is reinforced by the fabric pad to form a tough and rigid fabric-rubber cover piece which is able to be sewn easily. A ball cover made of such cover pieces is easily be grasped and thus has good slippery resistibility.

The sewing rubber American football is made by a specific manufacturing method comprising the steps of:

(a) cutting a rubber material into four elliptical rubber skin of a predetermined size;

(b) cutting a fabric material into four elliptical fabric pads having a same size of the rubber skin;

(c) compressing and vulcanizing each of the rubber skins with one of the fabric pads together in a press mold, so as to firmly united the rubber skin with the fabric pad integrally to form a fabric-rubber cover piece, in which one side of the press mold provides a plurality of circular dents evenly and uniformly distributed thereon, so that a top surface of the rubber skin is compressed to form a plurality of protruding pebbles evenly and uniformly distributed thereon;

(d) cutting each of the cover pieces to a predetermined size;

(e) sewing the cover pieces edge to edge together to form a ball cover, in which a section of the ball cover is not sewn to form an inlet opening;

(f) heating the ball cover and turning right side out;

(g) inserting a bladder into the ball cover through the inlet opening; and (h) sewing up the inlet opening.

DETAILED DESCRIPTION OF THE PREFERRED EMBODIMENT

Figure 1:
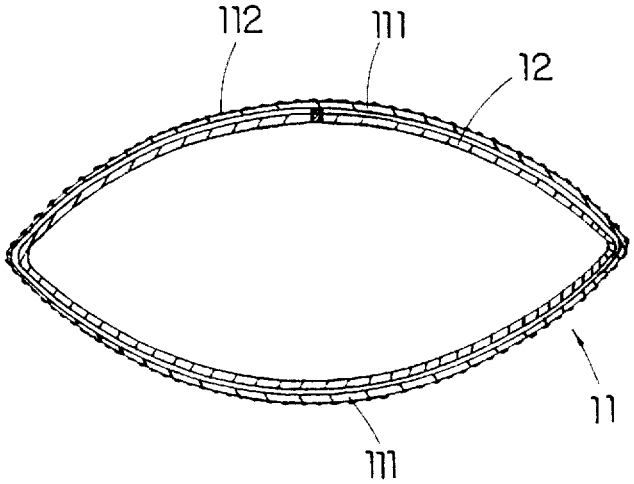
FIG. 1 PRIOR ART
FIG. 1 is a sectional view of a conventional American football.
Figure 2:
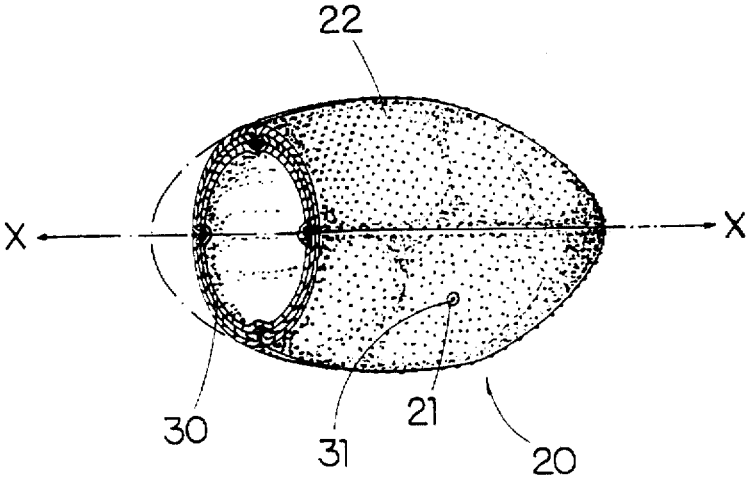
FIG. 2 is a sectional perspective view of a sewing rubber American football according to a preferred embodiment of the present invention.
Figure 3:
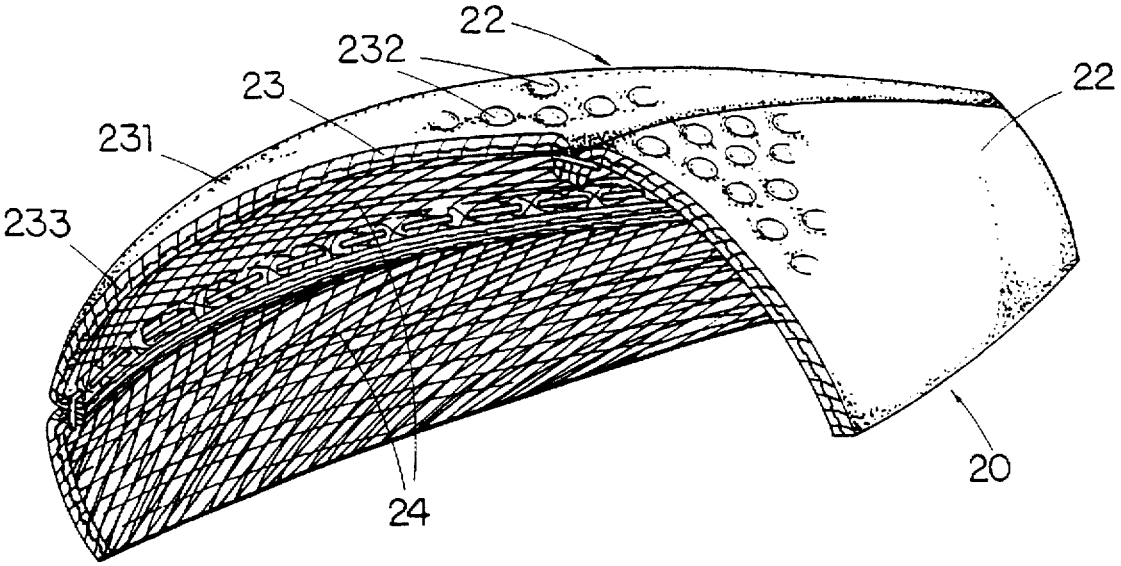
FIG. 3 is a partial sectional view of the sewing rubber American football according to the above preferred embodiment of the present invention.
Figure 4:
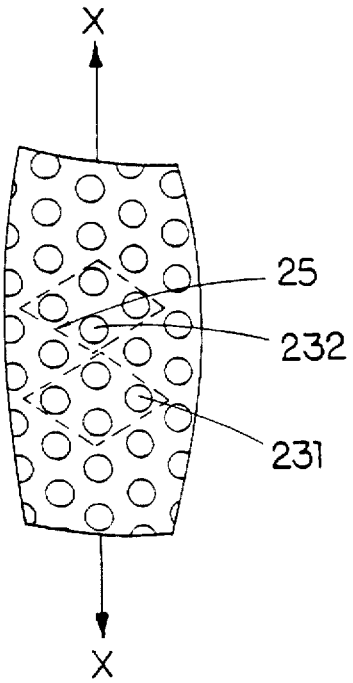
FIG. 4 is an enlarged view of the top surface of the ball cover of the sewing rubber American football according to the above preferred embodiment of the present invention.

Referring to FIGS. 2 to 4, a sewing rubber American football according to the preferred embodiment is illustrated. The sewing rubber American football comprises a ball cover 20 and a rubber bladder 30 disposed within the ball cover 20. The ball cover 20 has a valve hole 21 provided thereon and a predetermined shape. The bladder 30 has a valve stem 31 mounted thereon and extended through the valve hole 21 of the ball cover 20.

As shown in FIGS. 2 and 3, the ball cover 20 comprises four elliptical cover pieces 22 sewn edge to edge together. Each cover piece 22 comprises an outer elliptical rubber skin 23 and an inner elliptical fabric pad 24 integrally attached underneath the rubber skin 221 by compressing and vulcanizing, as shown in FIG. 3. A top surface 231 of the rubber skin 23 provides a plurality of protruding pebbles 232 evenly distributed all over the top surface, so as to facilitate the gripping and holding of the American football by the players. Therefore, the rubber top surface 231 of the American football provides good slipping resistibility to minimize the slippery while the players using their hands to grip, catch, transfer, flow, and hold the American football.

According to the present invention, the rubber skin 23 is reinforced by the fabric pad 24 to form the tough and rigid fabric-rubber cover piece 22 which is able to be sewn easily. In order to ensure the attachment of the rubber skin 23 and the fabric pad 24, the rubber skin 23 further provides a coarse bottom surface 233 which is full of bumps and dents for gripping with the fiber of the fabric pad 24 so as to firmly united with the fabric pad 24.

As shown in FIG. 4, in order to provide better grasping effect, the protruding pebbles 232 are constituted by a plurality of pebble units 25. Each pebble unit 25 is aligned edge to edge along a longitudinal axis X—X as shown in FIGS. 2 and 3. Each pebble unit 25 has four protruding pebbles 232 which are positioned in diamond pattern, in which a transverse distance of two transverse pebbles 232 is longer than a longitudinal distance of two longitudinal pebbles 232. In this manner, all the protruding pebbles 232 can be distributed evenly, uniformly and equally spaced apart and perform excellent grasping effect and slipping resistibility.

Figures 5, 5A, 5B, 5C, 5D, 5E, 5F, 5G:
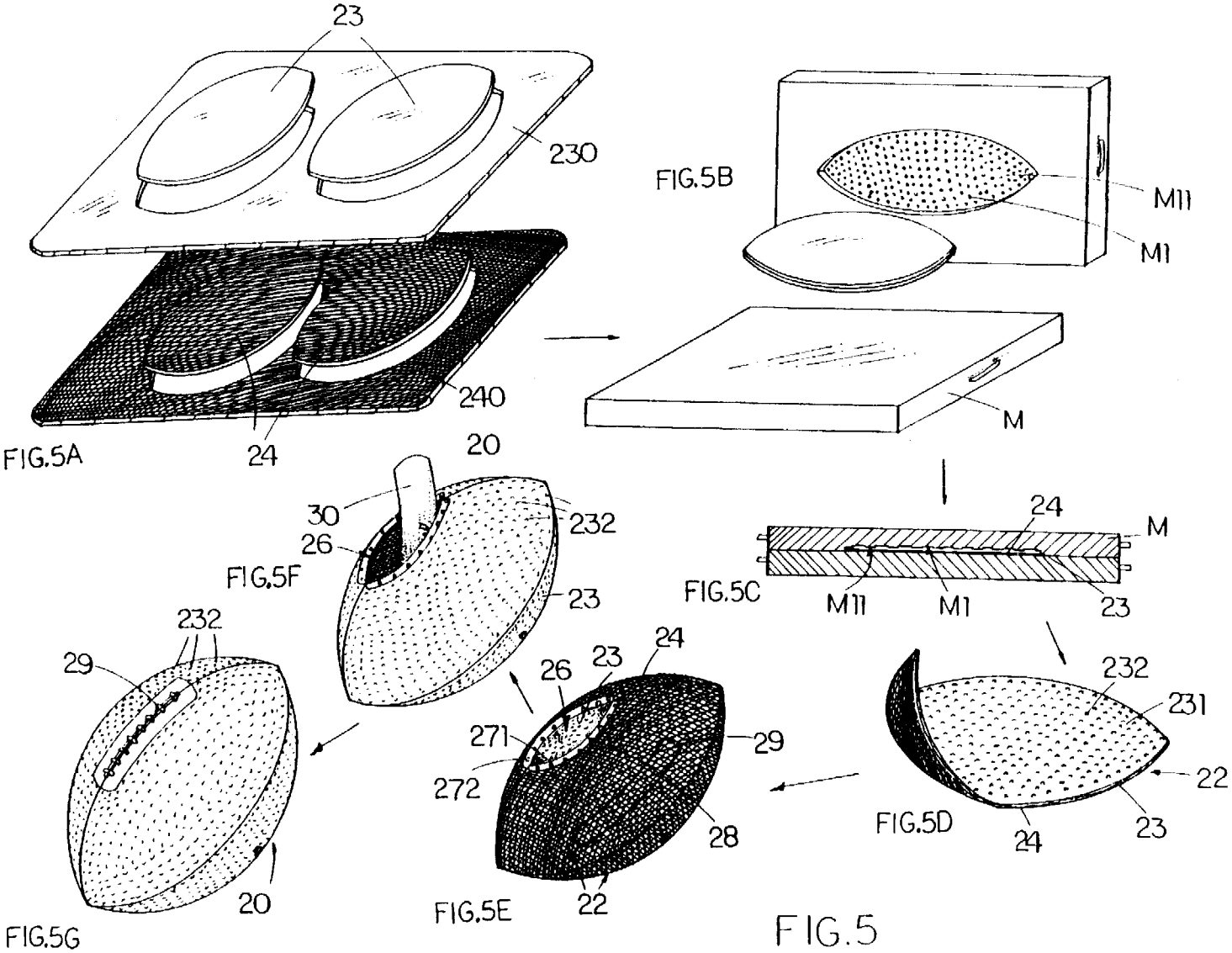
FIG. 5 is an illustrating view of a manufacturing method for the sewing rubber American football of the above embodiment of the present invention.

The sewing rubber American football as specified above is made by a specific manufacturing method which comprises the steps as follows, as shown in FIG. 5.

(a) Cut a rubber material 230 into four elliptical rubber skin 23 of a predetermined size, as shown in FIG. 6(*a*).

(b) Cut a fabric material 240 into four elliptical fabric pads 24 having a same size of the rubber skin 23, as shown in FIG. 6(*a*).

(c) Compress and vulcanize each of the rubber skins 23 with one of the fabric pads 24 together in a press mold M, so as to firmly united the rubber skin with the fabric pad integrally to form a fabric-rubber cover piece, in which one side MI of the press mold M provides a plurality of circular dents M11 evenly and uniformly distributed thereon, so that a top surface of the rubber skin is compressed to form a plurality of protruding peddles evenly and uniformly distributed thereon, as shown in FIGS. 6(*b*) and 6(*c*).

(d) Cut each of the cover pieces 22 to a predetermined size after each of the cover pieces 22 is cooled down to room temperature, as shown in FIG. 6(*d*).

(e) Sew the four cover pieces 22 edge to edge together to form a ball cover 20 by a sewing machine, in which a section of the ball cover 20 is not sewn to form an inlet opening 26, as shown in FIG. (*e*).

(f) Heat the ball cover 20 and turning right side out, as shown in FIG. 6(*f*).

(g) Insert a rubber bladder 30 into the ball cover 20 through the inlet opening 26, as shown in FIG. 6(*f*).

(h) Sew up the inlet opening 26 by hand to form the sewing rubber American football, as shown in FIG. 6(*g*).

In order to provide better attachment between the rubber skin 23 and the fabric pad 24, an additional step of adhering the fabric pad onto the rubber skin by rubber nature glue after the above step (b).

In order to reinforce the surrounding portion of the inlet opening 26 of the ball cover 20, the following additional steps can be added the manufacturing method specified above.

(1) After step (e), sew two linings 271, 272 symmetrically around the inlet opening 26 and a reinforcing cloth 28 underneath the inlet opening, as shown in FIG. 6(*e*).

(2) After the above step (1), form a plurality pair of string holes 29 around the inlet opening 26, as shown in FIGS. 6(*e*) and 6(*f*).

(3) After step (h), tighten a plurality of ball strings 29 between each pairs of string holes 28, as shown in FIG. 6(*g*).

I claim:

1. A manufacturing method of an American football, comprising the steps of:

(a) cutting a rubber material into four elliptical rubber skins having a predetermined size;

(b) cutting a fabric material into four elliptical fabric pad each having a same size of said rubber skins;

(c) compressing and vulcanizing each of said rubber skins with one of said fabric pads together in a press mold, so as to firmly united said rubber skins with said fabric pads respectively and integrally to form four fabric-rubber cover pieces, wherein one side of said press mold provides a plurality of circular dents evenly and uniformly distributed thereon, so that a top surface of each of said rubber skins is compressed to form a plurality of protruding peddles evenly and uniformly distributed thereon;

(d) cutting each of said cover pieces to a predetermined size after each of said cover pieces is cooled down to room temperature;

(e) sewing said four cover pieces edge to edge together to form a ball cover, wherein a section of said ball cover is not sewn to form an inlet opening; (f) sewing two linings symmetrically around said inlet opening and a reinforcing cloth underneath said inlet opening;

(g) forming a plurality of pairs of string holes around said inlet opening;

(h) heating said ball cover and turning said ball cover right side out;

(i) inserting a bladder into said ball cover through said inlet opening;

(j) sewing up said inlet opening; and (k) tightening a plurality of ball strings between each of said pairs of string holes respectively to form said American football.

2. A manufacturing method of an American football, as recited in claim 1, after step (b), further comprising the step of adhering each of said fabric pads into each of said rubber skin by a nature glue.

* * * * *